US009443534B2

(12) United States Patent
Gao

(10) Patent No.: US 9,443,534 B2
(45) Date of Patent: Sep. 13, 2016

(54) BANDWIDTH EXTENSION SYSTEM AND APPROACH

(75) Inventor: Yang Gao, Mission Viejo, CA (US)

(73) Assignee: Huawei Technologies Co., LTD., Shenzhen (CN)

( * ) Notice: Subject to any disclaimer, the term of this patent is extended or adjusted under 35 U.S.C. 154(b) by 866 days.

(21) Appl. No.: 13/086,956

(22) Filed: Apr. 14, 2011

(65) Prior Publication Data

US 2011/0257980 A1 Oct. 20, 2011

Related U.S. Application Data

(60) Provisional application No. 61/323,871, filed on Apr. 14, 2010, provisional application No. 61/323,872, filed on Apr. 14, 2010.

(51) Int. Cl.
*G10L 19/00* (2013.01)
*G10L 21/038* (2013.01)

(52) U.S. Cl.
CPC ..... *G10L 21/038* (2013.01)

(58) Field of Classification Search
CPC ..... G10L 21/038; G10L 19/0208
USPC ..... 704/265, 226, 223, 219, 205
See application file for complete search history.

(56) References Cited

U.S. PATENT DOCUMENTS 8,244,526 B2 * 8/2012 Vos et al. ..... 704/226
8,249,864 B2 * 8/2012 Lee et al. ..... 704/219
2003/0009327 A1 * 1/2003 Nilsson et al. ..... 704/219
2003/0093279 A1 * 5/2003 Malah et al. ..... 704/265
2005/0004803 A1 * 1/2005 Smeets et al. ..... 704/500
2006/0149538 A1 * 7/2006 Lee et al. ..... 704/219
2006/0277038 A1 * 12/2006 Vos et al. ..... 704/219
2007/0088541 A1 * 4/2007 Vos et al. ..... 704/219
2007/0147518 A1 * 6/2007 Bessette ..... 375/243
2008/0077412 A1 * 3/2008 Oh et al. ..... 704/500
2008/0195392 A1 * 8/2008 Iser et al. ..... 704/265
2009/0043574 A1 * 2/2009 Gao et al. ..... 704/223
2009/0192806 A1 * 7/2009 Truman et al. ..... 704/500
2009/0319283 A1 * 12/2009 Schnell et al. ..... 704/503
2010/0010809 A1 * 1/2010 Oh et al. ..... 704/206
2010/0063803 A1 * 3/2010 Gao ..... 704/205
2010/0121646 A1 * 5/2010 Ragot et al. ..... 704/500
2010/0145685 A1 * 6/2010 Nilsson et al. ..... 704/205

OTHER PUBLICATIONS

Yong Zhang et al., "Artificial Mobile Audio Bandwidth Extension", IEEE 2006, pp. 410-413.*

* cited by examiner

*Primary Examiner* — Douglas Godbold
*Assistant Examiner* — Mark Villena
(74) *Attorney, Agent, or Firm* — Slater Matsil, LLP

(57) ABSTRACT

A method of performing BandWidth Extension (BWE) includes a frequency band shifting approach to generate an extended high band signal in time domain and a gain determination approach of controlling the energy of the extended high band. The proposed approach allows shifting any size of low band to any size of high band. The BWE scaling gain is estimated by using available filter bank coefficients with extremely low bit rate or without costing any bit, combining three possible gain factors.

28 Claims, 9 Drawing Sheets

BANDWIDTH EXTENSION SYSTEM AND APPROACH

This application claims the benefit of U.S. Provisional Application No. 61/323,871 filed on Apr. 14, 2010, entitled "Frequency Band Shifting Approach for Bandwidth Extension," and U.S. Provisional Application No. 61/323,872 filed on Apr. 14, 2010, entitled "Gain Control Approach for Very Low Cost Bandwidth Extension," which applications are incorporated by reference herein.

TECHNICAL FIELD

The present invention relates generally to audio/speech processing, and more particularly to a system and method for audio/speech coding, decoding and post-processing.

BACKGROUND

In modern audio/speech digital signal communication system, digital signal is compressed at encoder. The compressed information (bitstream) can be packetized and sent to decoder through a communication channel frame by frame. The system of encoder and decoder together is called codec. Speech/audio compression may be used to reduce the number of bits that represent the speech/audio signal thereby reducing the bit rate needed for transmission. However, speech/audio compression may result in quality degradation of decompressed signal. In general, a higher bit rate results in higher quality, while a lower bit rate causes lower quality.

In application for signal compression, some frequencies are more important than others. The important frequencies can be coded with a fine resolution. Small differences at these frequencies are significant and a coding scheme that preserves these differences must be used. On the other hand, less important frequencies do not have to be exact. A coarser coding scheme can be used, even though some of the finer details will be lost in the coding. Low frequency band is often more important than high frequency band so that low frequency band can be coded with a fine resolution which could be time domain coding approach or frequency domain coding approach. High frequency band is often less important than low frequency band so that high frequency band can be coded with a much coarser resolution which could also be time domain coding approach or frequency domain coding approach. Typical coarser coding scheme is based on a concept of BandWidth Extension (BWE) which is widely used. This technology concept sometimes is also called High Band Extension (HBE), SubBand Replica (SBR) or Spectral Band Replication (SBR). Although the name could be different, they all have the similar meaning of encoding/decoding some frequency sub-bands (usually high bands) with little budget of bit rate (even zero budget of bit rate) or significantly lower bit rate than normal encoding/decoding approach. With SBR technology, the spectral fine structure in high frequency band is copied from low frequency band and some random noise could be added; then, the spectral envelope in high frequency band is shaped by using side information transmitted from encoder to decoder; if the extended bandwidth is wide, the spectral envelope or spectral energy in high frequency band can be simply shaped by applying gains estimated from available information at decoder side.

Audio coding based on filter bank technology is widely used especially for music signals. In signal processing, a filter bank is an array of band-pass filters that separates the input signal into multiple components, each one carrying a single frequency subband of the original signal. The process of decomposition performed by the filter bank is called analysis, and the output of filter bank analysis is referred to as a subband signal with as many subbands as there are filters in the filter bank. The reconstruction process is called filter bank synthesis. In digital signal processing, the term filter bank is also commonly applied to a bank of receivers. The difference is that receivers also down-convert the subbands to a low center frequency that can be re-sampled at a reduced rate. The same result can sometimes be achieved by undersampling the bandpass subbands. The output of filter bank analysis could be in a form of complex coefficients; each complex coefficient contains real element and imaginary element respectively representing cosine term and sine term for each subband of filter bank.

SUMMARY OF THE INVENTION

In accordance with an embodiment, a method of performing BandWidth Extension (BWE), the method includes a frequency band shifting approach to generate extended frequency band and a gain determination approach of controlling energy of the shifted frequency band or generated frequency band.

In accordance with a further embodiment, a method for generating an extended frequency band includes shifting a low frequency band to high frequency band location, the method having a low complexity solution in time domain to realize the frequency band shifting. The proposed approach is similar to QMF filtering concept; but, instead of symmetric QMF filters, non symmetric filters are used to allow shifting any size of low band to any size of high band.

In accordance with a further embodiment, a method of estimating a BWE scaling gain by using available filter bank coefficients with extremely low bit rate or without costing any bit, the method of determining a BWE scaling gain includes determining three gain factors: Gain_t[ ] to sharpen time evaluation energy envelope, Gain_1[ ] estimated from nearest available high band filter bank coefficients, and Gain_2[ ] estimated by considering energy ratio between the energy at the lowest frequency area and the lowest energy in all available subbands.

In accordance with a further embodiment, a non-transitory computer readable medium has an executable program stored thereon, where the program instructs a microprocessor to decode an encoded audio signal to produce a decoded audio signal, where the encoded audio signal includes a coded representation of an input audio signal. The program also instructs the microprocessor to perform a specific BWE approach.

The foregoing has outlined rather broadly the features of an embodiment of the present invention in order that the detailed description of the invention that follows may be better understood. Additional features and advantages of embodiments of the invention will be described hereinafter, which form the subject of the claims of the invention. It should be appreciated by those skilled in the art that the conception and specific embodiments disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the embodiments, and the advantages thereof, reference is now made to the following descriptions taken in conjunction with the accompanying drawings, in which:

FIG. 1, which includes

FIG. 1*a* illustrates the encoder with transmitting SBR side information;

FIG. 1*b* illustrates the decoder with the filter bank based SBR;

FIG. 2, which includes

FIG. 2*a* illustrates the encoder with transmitting SBR side information;

FIG. 2*b* illustrates the decoder with the filter bank based SBR and extra SBR;

FIG. 3 illustrates a general principle of encoder and decoder with SBR without using filter bank;

FIG. 4, which includes FIGS. 4*a*-4*f* gives an explanation of up-sampling and spectrum extension manipulation to realize frequency band shifting;

FIG. 5 illustrates a general principle of encoder and decoder with an example of normal SBR and very low cost extra SBR;

DETAILED DESCRIPTION OF ILLUSTRATIVE EMBODIMENTS

The making and using of the embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to various embodiments in a specific context, a system and method for audio coding and decoding. Embodiments of the invention may also be applied to other types of signal processing such as those used in medical devices, for example, in the transmission of electrocardiograms or other type of medical signals.

Frequency band shifting or copying from low band to high band is normally the first step for SBR technology. When filter bank analysis and synthesis are available at decoder covering desired spectrum range, SBR algorithm can just realize frequency band shifting by simply copying low frequency band coefficients of the output from filter bank analysis to high frequency band area; otherwise, performing new filter bank analysis and synthesis at decoder could cost a lot of complexity. If filter bank analysis and synthesis are not available at decoder, or an extra extremely low bit rate (even 0 bit rate) SBR needs to be added, a time domain solution can be considered. This invention proposes a low complexity solution in time domain to realize frequency band shifting from lower band to higher band. The proposed approach is similar to QMF (Quadrature Mirror Filters) filtering concept; but, instead of symmetric QMF filters, non symmetric filters are used to allow shifting any size of low band to any size of high band.

Figure 1A:
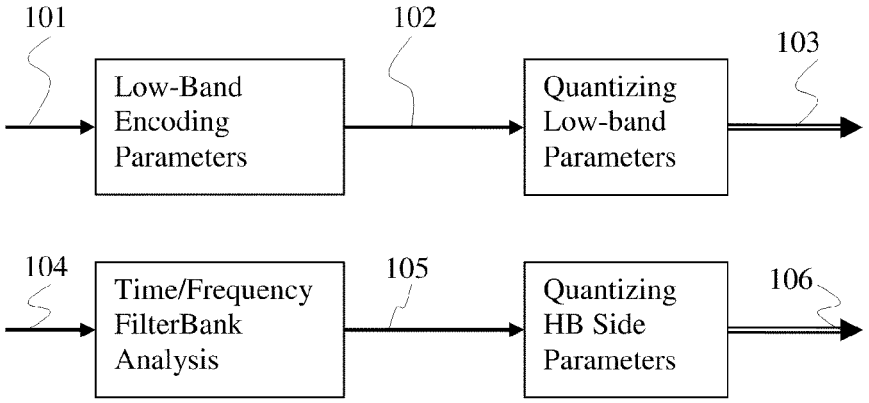
FIGS. 1*a* and 1*b*, illustrates a general principle of encoder and decoder with filter bank based SBR.
Figure 1B:
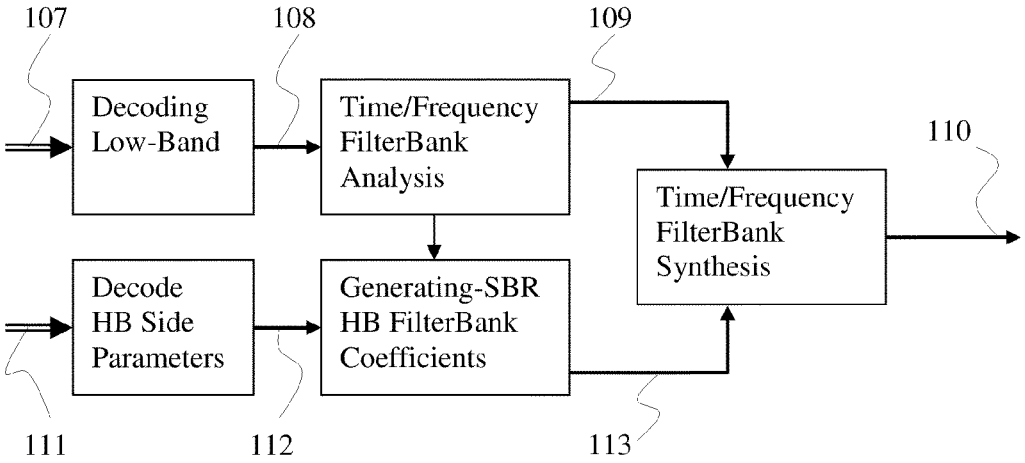

FIG. 1 shows an example of doing SBR through filter bank analysis and synthesis. In FIG. 1, suppose that the low band signal is encoded/decoded with any coding scheme while the high band is encoded/decoded with low bit rate SBR scheme. Original low band audio signal 101 at encoder is encoded to have the corresponding low band parameters 102 which are then are quantized and transmitted to decoder through bitstream channel 103. The high band signal 104 is encoded/decoded with SBR technology; only the high band side information 105 is quantized and transmitted to decoder through bitstream channel 106. At decoder, the low band bitstream 107 is decoded with any coding scheme to obtain the low band signal 108 which is again transformed into the low band filter bank output coefficients 109 by filter bank analysis. The high band side bitstream 111 is decoded to have the high band side parameters 112 which usually contain the high band spectral envelope. The high band filter bank coefficients 113 are generated by copying the low band filter bank coefficients, shaping the high band spectral energy envelope with received side information, and adding proper random noise. The low band filter bank coefficients 109 and the high band filter bank coefficients 113 are combined before sent to filter bank synthesis which produces the output audio signal 110.

Figure 2A:
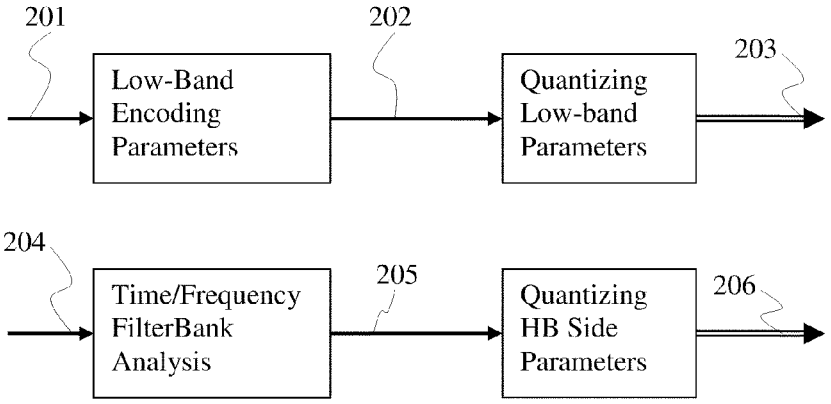
FIGS. 2*a* and 2*b*, illustrates a general principle of encoder and decoder with filter bank based SBR and low complexity extra SBR.
Figure 2B:
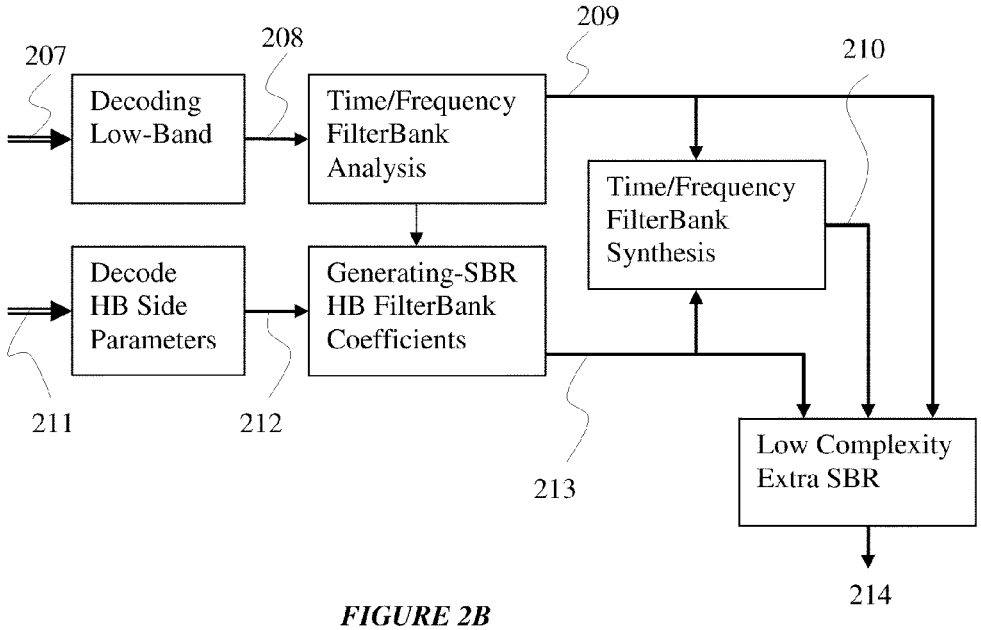

FIG. 2 shows an example of doing extra low complexity SBR; the frequency shifting for the SBR is realized by the proposed algorithm; the existing low band filter bank coefficients 209 and high band filter bank coefficients 213 are used to estimate the gain to control the energy of the extra low complexity SBR. FIG. 2*a* shows an encoder which is the same as FIG. 1*a*. The decoder of FIG. 2*b* is also similar to FIG. 1*b*. Compared to FIG. 1*b*, FIG. 2*b* adds the extra low complexity SBR which further extends the output audio signal 210 to the final output audio signal 214.

Figure 3A:
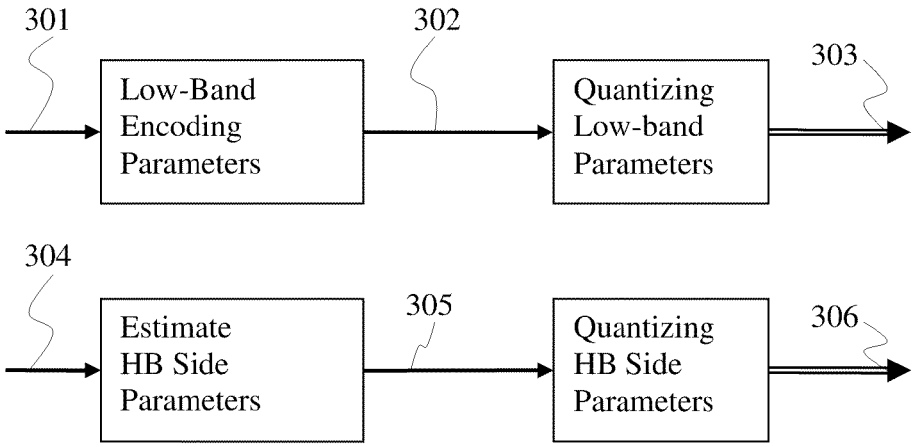
FIG. 3*a* illustrates the encoder with transmitting SBR side information.
Figure 3B:
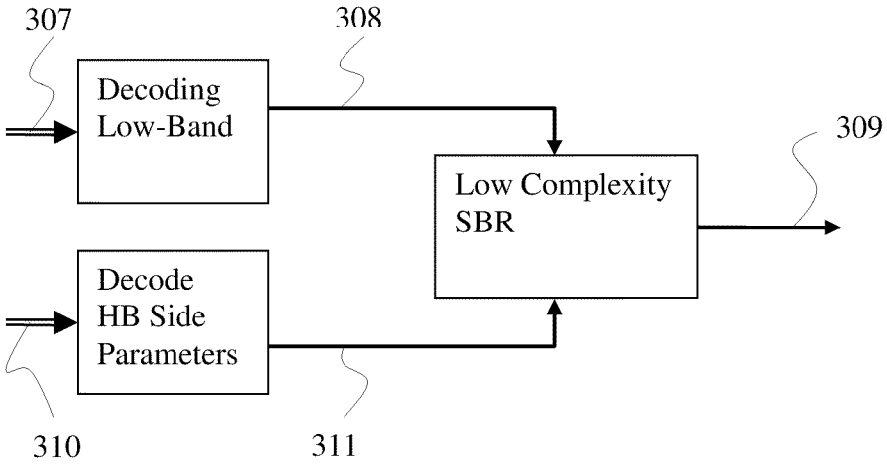
FIG. 3*b* illustrates the decoder with SBR without using filter bank.

FIG. 3 shows another example of doing low complexity SBR with the proposed frequency shifting approach and without using filter bank coefficients. FIG. 3*a* shows an encoder which is similar to FIG. 1*a*; but not necessary to use time/frequency filter bank analysis. In FIG. 3, suppose that the low band signal is encoded/decoded with any coding scheme while the high band is encoded/decoded with low bit rate SBR scheme. Original low band audio signal 301 at encoder is encoded to have the corresponding low band parameters 302 which are then are quantized and transmitted to decoder through bitstream channel 303. The high band signal 304 is encoded/decoded with SBR technology; only the high band side information 305 is quantized and transmitted to decoder through bitstream channel 306. At decoder, the low band bitstream 307 is decoded with any coding scheme to obtain the low band signal 308. The high band side bitstream 310 is decoded to have the high band side parameters 311 which usually contain the high band spectral envelope. The extended high band is generated by shifting low band to high band, shaping the high band spectral energy envelope with received side information, and adding proper random noise. The up-sampled low band signal and the generated high band signal are added together to obtain the final output signal 309.

The detailed algorithm of doing frequency shifting in time domain will be explained through the following example. Assume that there is a codec at 12 kbps; the basic output of the 12 kbps decoder is at sampling rate of 25.6 kHz, resulting in a bandwidth of [0, 12.8 kHz]. If we want to extend the bandwidth of the 12 kbps codec up to [0-16 kHz], the high band [12.8-16 kHz] should be added by doing SBR. It will be too complicated to do the SBR by performing new filter bank analysis/synthesis at decoder. A frequency shifting approach in time domain is proposed here to move the spectrum band of [9.6-12.8 kHz] to the higher band [12.8-16 kHz]. The time domain bandwidth extension algorithm is similar to QMF filtering approach; however, instead of symmetric QMF filtering, specific non-symmetric filtering approach has been used.

Figure 4A:
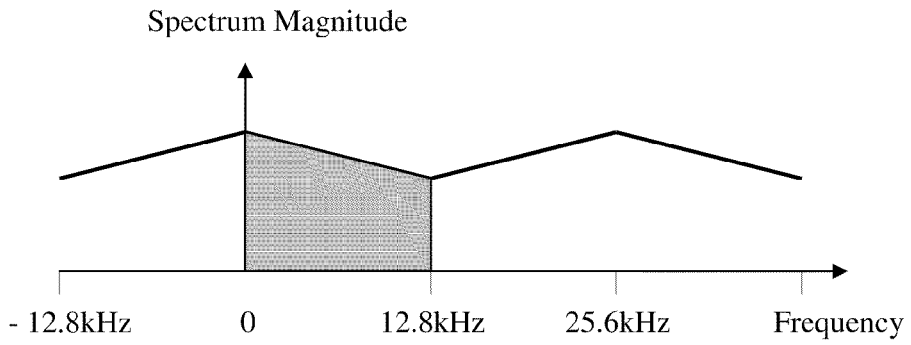
FIG. 4*a* illustrates an example of an audio signal spectrum at sampling rate of 25.6 kHz.
Figure 4B:
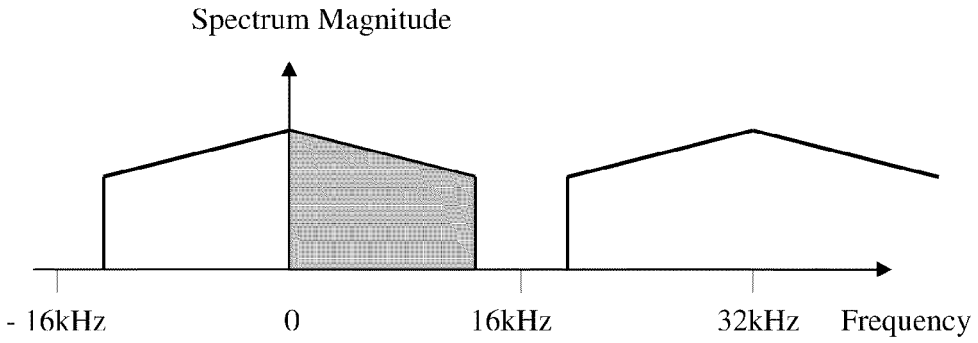
FIG. 4*b* illustrates an example of an audio signal spectrum by up-sampling (a) to sampling rate of 32 kHz.
Figure 4C:
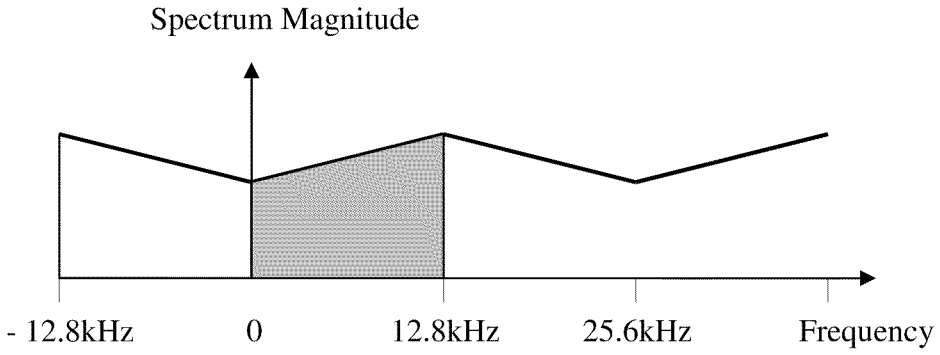
FIG. 4*c* illustrates an example of an audio signal spectrum by mirroring (a) at sampling rate of 25.6 kHz.
Figure 4D:
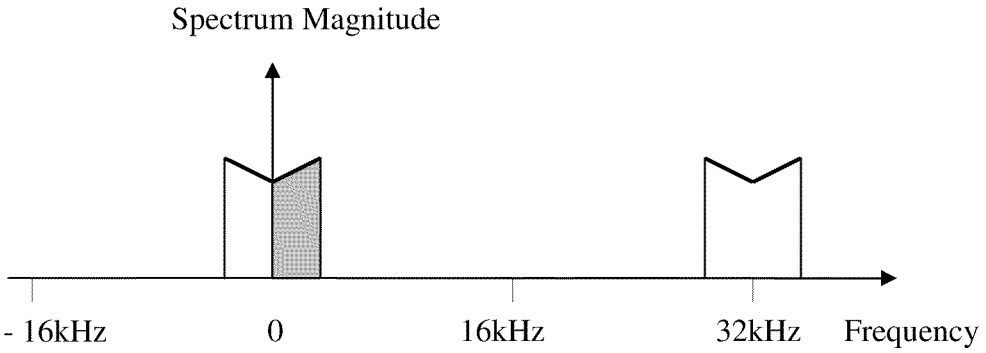
FIG. 4*d* illustrates an example of an audio signal spectrum by low-passing and up-sampling (c) to sampling rate of 32 kHz.
Figure 4E:
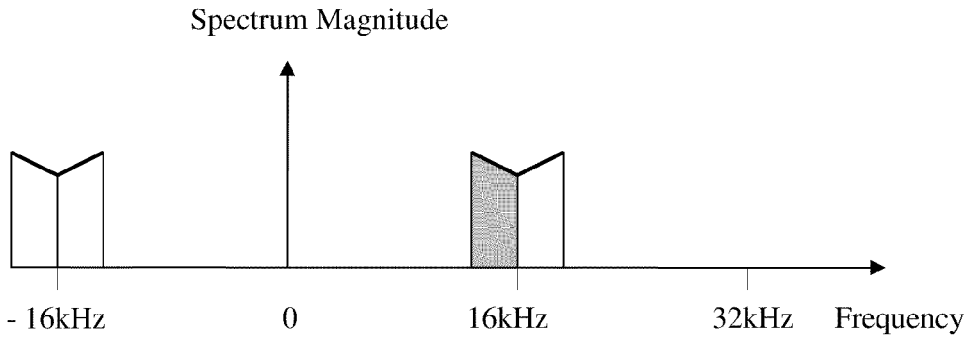
FIG. 4*e* illustrates an example of an audio signal spectrum by mirroring (d) at sampling rate of 32 kHz.
Figure 4F:
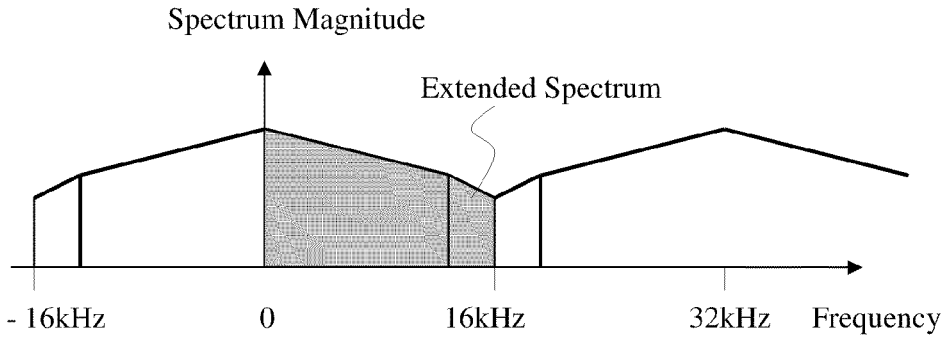
FIG. 4*f* illustrates an example of an audio signal spectrum by adding (b) and (e) to get bandwidth extended spectrum.

From FIG. 4*a* to FIG. 4(*f*), the basic principle to do frequency shifting (bandwidth extension) in time domain has been explained. FIG. 4*a* shows a spectrum of an audio signal $\hat{s}(n)$ of the 12 kbps codec, which supposes to be the baseband audio signal. FIG. 4*b* shows the spectrum of the baseband up-sampled signal after up-sampling the baseband audio signal $\hat{s}(n)$ of FIG. 4*a* from 25.6 kHz to 32 kHz; the up-sampling processing can be realized by using popular Windowed Sinc Functions with or without adding low-pass filtering. FIG. 4(*c*) shows the spectrum of the baseband mirrored signal after simple minor operation of the baseband audio signal $\hat{s}(n)$ of FIG. 4*a*; the mirror operation of $\hat{s}(n)$ is performed by $$\hat{s}_{mirror}(n) = \begin{cases} \hat{s}(n), & n = 0, 2, 4, \ldots \\ -\hat{s}(n), & n = 1, 3, 5, \ldots \end{cases} \quad (1)$$

FIG. 4(*d*) shows the spectrum of the high band mirrored signal after non-symmetric low-pass-filtering and up-sampling the mirrored baseband signal of FIG. 4(*c*), in which the non-symmetric low-pass-filter and the up-sampling filter can be simply combined into one zero phase filter designed with popular Windowed Sinc Functions. FIG. 4(*e*) shows the spectrum of the extra high band signal after simply mirroring again the low-pass-filtered and up-sampled signal (the high band mirrored signal); the output of FIG. 4(*e*) can be further spectrum-shaped with some filtering operation or energy-controlled by applying a gain to have a scaled extra high band signal; even some noise can be added to this signal. FIG. 4(*f*) shows the spectrum with the extended spectrum by adding the signal of FIG. 4*b* and the signal of FIG. 4(*e*).

The extended signal of FIG. 4(*e*) needs to be properly scaled; the scaling gain can be determined by using filter bank coefficients if they are available as shown in FIG. 2; the gain can be also estimated by using the transmitted side information as shown in FIG. 3. The gain is normally updated for every time interval such as about 2.5 ms. If the gain is applied in time domain, it should be further smoothed at every output sample before applied to the extended signal.

A gain determination here is proposed for extremely low bit rate BWE algorithm or even 0 bit rate BWE algorithm. Assume that the extended high frequency band is not very wide, the extended bandwidth is quite limited, and the extended fine spectrum is generated without costing any bit or at very low bit rate; the remaining main issue is the energy control of the extended high frequency band or the scaling gain determination of the extended high frequency band. Assume also that the filter bank coefficients of Analysis-Synthesis for decoded output signal are available at decoder side; an algorithm to estimate the BWE scaling gain is suggested by using the available filter bank coefficients with extremely low bit rate or without costing any bit. In order to explain the ideas clearly without losing generality, a detailed algorithm example is given as the followings; all the concepts are included in the example although the detailed parameters actually can vary for different applications.

Suppose there is a codec operating at 8 kbps mode; the decoder output in the frequency range of [0-9.6 kHz] at sampling rate of 19200 Hz is represented by 64 complex coefficients of frequency direction:

$$\{Sr[l][k], Si[l][k]\},\ k=0, 1, 2, \ldots, 63; \quad (2)$$

which are from the output of the decoder filter bank analysis; in the above expression, l is time direction index; k is the frequency direction index; suppose again that the complex coefficients from k=49 to k=63 are initially set to zeros because they are not coded by the codec due to limited low bit rate, resulting in the real output bandwidth of [0-7.35 kHz]; the BWE algorithm will fill up the frequency band [7.35-9.6 kHz] with very low cost.

Figure 5A:
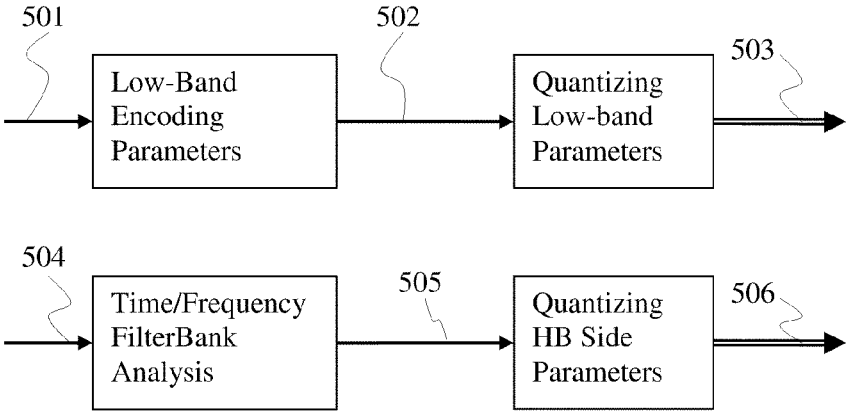
FIG. 5*a* illustrates the encoder with SBR side information.
Figure 5B:
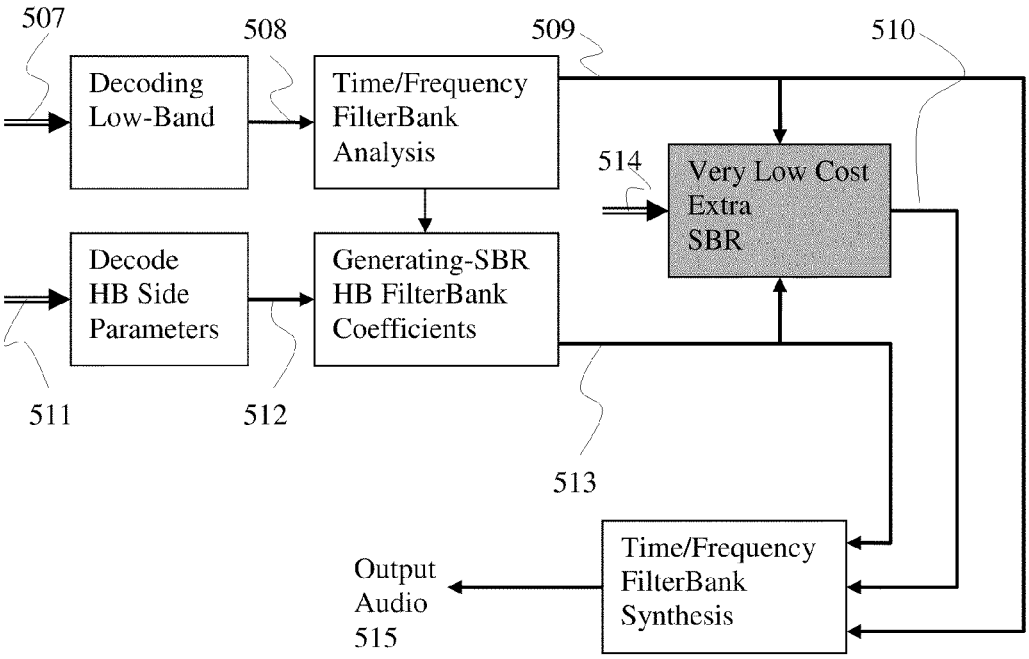
FIG. 5*b* illustrates the decoder with very low cost extra SBR.

FIG. 5 shows a specific example of audio/speech codec and the location to do the extra very low cost SBR. FIG. 5 is very similar to FIG. 2. The encoder in FIG. 5*a* is the same as FIG. 2*a*. The difference of FIG. 5*b* decoder from FIG. 2*b* decoder is that the extra high band shifting/copying in FIG. 5*b* decoder is realized in frequency domain before filter bank synthesis while the extra high band shifting/copying in FIG. 2*b* decoder is performed in time domain after filter bank synthesis. In FIG. 5*b*, bits 514 carries possible side information to control the extra SBR. First, the filter bank coefficients from k=49 to k=63 are copied from low band of from k=33 to k=47, as done with SBR concept; then, the copied coefficients are shaped and some controlled random noise is added to the copied coefficients. If the filter bank coefficients in the extended frequency band is not available at decoder, other frequency band shifting approach such as previously described time domain algorithm can be used. The controlling parameters are estimated according to available information and classifications.

The extra SBR high band can be expressed as for k=49, 50, . . . , to k=63:

$$Sr[l][k]=Gs[l]\cdot\mathrm{Gain}[l]\cdot Sr[l][k-16]\cdot\mathrm{Shape}[k-49]+Gn[l]\cdot\mathrm{Noise}[l][k];$$

$$Si[l][k]=Gs[l]\cdot\mathrm{Gain}[l]\cdot Si[l][k-16]\cdot\mathrm{Shape}[k-49]+Gn[l]\cdot\mathrm{Noise}[l][k]; \quad (3)$$

l is the time index which represents about 3.335 ms step for 8 kbps codec at sampling rate of 19200 Hz; k is the frequency index indicating 150 Hz step for the 8 kbps codec; Sr[l][k] and Si[l][k] are the filter bank complex coefficients; Noise[l][k] is random noise; the gain factors Gs[l] and Gn[l] are set to control the energy ratio between the copied component and the noise component; Shape[ ] is used to modify the spectrum shape, which could be simply set to 1; one of the key parameters is the gain Gain[l] which is used to control the energy evaluation of the coefficients from k=49 to k=63, representing the frequency band of [7.35-9.6 kHz]. In most cases, the gain can be well estimated from available decoder information; sometimes it needs help from very limited information transmitted from encoder in order to guarantee the reliability while increasing wide bandwidth feeling without introducing noisy sound; an example of very low bit rate side information is that only 2 bits per 2048 output samples or 1 bit per 1024 output samples are transmitted from encoder, costing only 18.75 bps that is 0.23% of 8 kbps; the transmitted bits tell the decoder when the gain should be low enough for the current frame of 1024 output samples. The gain is expressed as $$\text{Gain}[l]=\text{Gain_}t[l]\cdot\text{Gain_1}[l]\cdot\text{Gain_2}[l]; \tag{4}$$

composed of three gain factors: Gain_t[l] to sharpen the time evaluation energy envelope, Gain_1[l] estimated from nearest available high band coefficients, and Gain_2[l] estimated by considering the energy ratio between the energy at the lowest frequency area and the lowest energy in all available subbands. More details are given in the following:

Determination of Gain_t[l]

Figure 6:
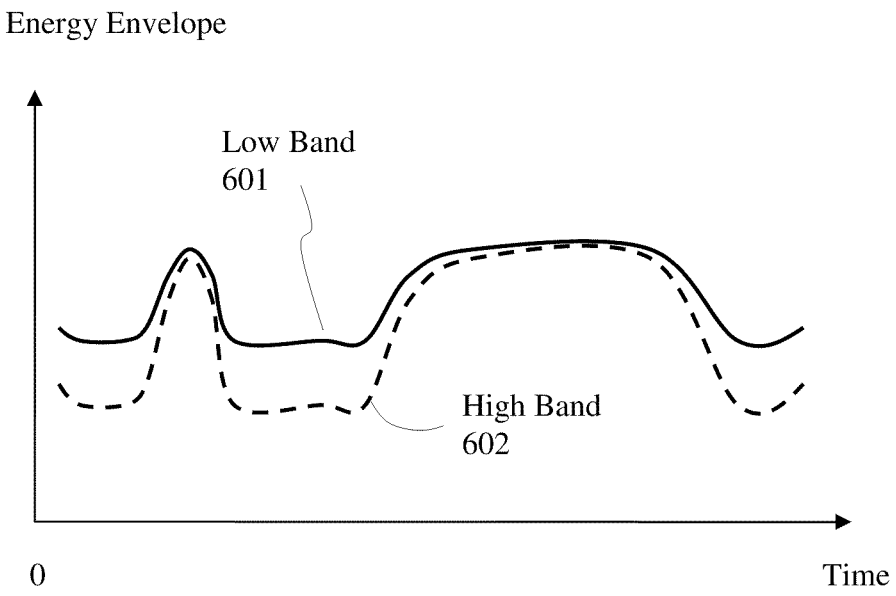
FIG. 6 illustrates an example of energy envelope comparison between low band and high band for a speech signal.

The energy evaluation at low frequency subband could be significantly different from high frequency subband, especially for speech signal. Usually, the time direction energy envelope in higher subband is sharper than that lower subband; FIG. 6 shows an example comparing low band time direction energy envelope 601 with high band time direction energy envelope 602. The sharpening Gain_t[l] is estimated from the subband of k=40 to k=49. Time/Frequency energy array from the filter bank complex coefficients for a long frame of 2048 output samples at decoder is calculated:

$$X(l,k)=\{Sr[l][k],Si[l][k]\}; \tag{5}$$

$$TF_\text{energy}[l][k]=X(l,k)X^*(l,k)=(Sr[l][k])^2+(Si[l][k])^2,\quad l=0,1,2,\ldots,31;\ k=0,1,\ldots,K1-1; \tag{6}$$

suppose K1=49 for the 8 kbps codec; TF_energy[l][k] represents energy distribution in time/frequency two dimensions. The time direction energy distribution is estimated by averaging frequency direction energies:

$$\text{T_energy}[l]=\text{Average}\{\text{TF_energy}[l][k],\text{ for all } k \text{ of } k=40 \text{ to } k=49\} \tag{7}$$

$$=\frac{1}{10}\sum_{k=40}^{49}\text{TF_energy}[l][k],$$

T_energy[l] can be smoothed from previous time index to current time index by excluding energy dramatic change (not smoothed at dramatic energy change point). If the smoothed T_energy[l] is noted as T_energy_sm[l], an example of T_energy_sm[l] can be expressed as

```
if ( (T__energy[l]>T__energy__sm[l−1]*4) or
     (T__energy[l]<T__energy__sm[l−1]/4) )
        {
        T__energy__sm[l] = T__energy[l] ;
            }
        else {
     T__energy__sm[l] = (T__energy__sm[l−1] + T__energy[l])/2 ;
            }
```

The time direction energy envelope sharpening gains are initialized by $$\text{Gain_}t[l]=\text{pow}(T_\text{energy_}sm[l],t_\text{control})=(T_\text{energy_}sm[l])^{t_control} \tag{8}$$

t_control is a constant parameter about 0.125. t_control=0 means no sharpening gain is applied. The initial gains Gain_t[l] should be energy-normalized at each time index by comparing the strongly smoothed original energy to the strongly smoothed energy of after putting the initial gains:

$$\text{T_energy_0_sm}[l]=(31\cdot\text{T_energy_0_sm}[l-1]+\text{T_energy}[l])/32 \tag{9}$$

$$\text{T_energy_1_sm}[l]=(31\cdot\text{T_energy_1_sm}[l-1]+\text{T_energy}[l]\cdot(\text{Gain_t}[l])^2)/32 \tag{10}$$

$$\text{Gain_t_norm}[l]=\sqrt{\frac{\text{T_energy_0_sm}[l]}{\text{T_energy_1_sm}[l]}} \tag{11}$$

The normalization gain Gain_t_norm[l] is applied to the initial gain for each time index to obtain the final time direction sharpening gains:

$$\text{Gain_t}[l]\Leftarrow\text{Gain_t_norm}[l]\cdot\text{Gain_t}[l] \tag{12}$$

The gain is limited to certain variation range. Typical limitation could be $$0.6\le\text{Gain_t}[l]\le1.1 \tag{13}$$

Determination of Gain_1[l]

The long frame with 32 time direction indices of l and 2048 output samples is divided into 4 smaller frames of 8 time direction indices of l and 512 output samples; for each smaller frame of time direction, frequency direction is divided into 10 subbands from low frequency to high frequency and each subband energy can be expressed as:

$$SubEnergy[j]=\sum_{l}\sum_{k=j\cdot5}^{j\cdot5+5}\text{TF_energy}[l][k],\ j=0,1,\ldots,9; \tag{14}$$

The maximum subband energy in the last 3 high subbands is noted as, $$\text{MaxE}=\text{MAX}\{\text{SubEnergy}[7],\text{SubEnergy}[8],\text{SubEnergy}[9]\}$$

The energy of the last high subband is noted as, $$\text{MinE1}=\text{SubEnergy}[9]$$

or MinE1 is defined as $$\text{MinE1}=\text{MIN}\{\text{SubEnergy}[8],\text{SubEnergy}[9]\}$$

The gain factor of Gain_1[l] in each frame is defined as, $$\text{Gain_1}[l]=pow\left(\frac{MinE1}{MaxE},C1\right); \tag{15}$$

C1 is a constant which could be 0.5 or other value; MinE1 is the local minimum subband energy near the extended high band; MaxE is the local maximum subband energy near the extended high band; Gain_1[l] is basically a local energy prediction gain by analyzing the near frequency coefficients which will be copied from lower band to higher band. Gain_1[l] is limited to be smaller than 1.

Determination of Gain_2[l]

The third gain factor is estimated by considering the energy variation of all subbands. The energy of the lowest subbands is marked as, if (SubEnergy[1]<SubEnergy[0])

$$LowE=SubEnergy[0]\cdot C1_{LowE}$$

else $$LowE=SubEnergy[1]\cdot C1_{LowE}$$

or $$LowE=(SubEnergy[0]+SubEnergy[1])\cdot 0.5\cdot C1_{LowE}$$

$C1_{LowE}$ is a constant factor which is much smaller than 1; if the transmitted low level flag is not true (LowLevelFlag=0), which means the normal level flag is true (NormalLevelFlag=1), LowE is further reduced by a constant factor:

if (NormalLevelFlag is true) or (LowLevelFlag is not true)

$$LowE \Leftarrow LowE\cdot C2_{LowE}$$

The lowest subband energy is searched in all the subbands by $$MinE2=MIN\{SubEnergy[j], j=0, 1, \ldots, 9\}$$

The third gain factor Gain_2[l] is defined as $$Gain_2[l] = pow\left(\frac{MinE2}{LowE}, C2\right); \tag{16}$$

C2 is a constant which could be 0.5 or other value; LowE represents the subband energy in the lowest frequency area, multiplied by a constant factor which is much smaller than 1; MinE2 represents the lowest subband energy of all the subbands. Gain_2[l] is limited to a value smaller than 1. After combining all the 3 gain factors, the final gain Gain[l] is smoothed from previous index l−1 to current index l, and the minimum value of Gain[l] is limited according to the transmitted low level indication flag and signal classification; the signal classification is done at decoder side by profiting from already received Mode or Class information, which intends to classify signal into Clean Speech, Noisy Signal, and Pure Music.

Determination of Random Noise Energy Percentage

The energy of random noise component Noise[l][k] is first normalized to the energy of the gained, shaped and copied filter bank coefficients, $$Sr'[l][k] = Gain[l]\cdot Sr[l][k-16]\cdot Shape[k-49], \quad k = 49, \ldots 63; \tag{17}$$

$$St'[l][k] = Gain[l]\cdot Si[l][k-16]\cdot Shape[k-49], \quad k = 49, \ldots 63;$$

$$Energy_bwe[l] = \sum_{k=49}^{63} (Sr'[l][k])^2 + (St'[l][k])^2; \tag{18}$$

The noise component energy is first made equal to Energy_bwe[l]; then, the noise energy percentage is controlled by two gain factors of Gs[l] and Gn[l], which are determined in terms of the classification information:

```
if (HarmonicToneFlag is true) {
    Gs[l] = 1; Gn[l] = 0;
}
else if (NoisyFlag is true) {
    Gs[l] = 0.5; Gn[l] = 0.7;
}
else {
    Gs[l] = 0.7; Gn[l] = 0.5;
}
```

Gs[l] and Gn[l] are smoothed during switching. HarmonicToneFlag is determined in terms of SpectralSharpnessParameter and classifications; in order to calculate SpectralSharpnessParameter, average energy distribution in frequency direction is evaluated:

$$F_energy[k] = \sum_{l} TF_energy[l][k],\ k = 39, 40, \ldots, 48;$$

$$F_energy_av = (1/10)\sum_{k=39}^{48} F_energy[k]$$

$$F_energy_peak = MAX\{F_energy[k], k = 39, 40, \ldots, 48\}$$

$$SpectralSharpnessParameter = \frac{F_energy_av}{F_energy_peak}$$

$$HarmonicToneFlag = (SpectralSharpnessParameter < 0.32)$$

and (Non Speech is true) and (Normal Signal Level is true)

NoisyFlag is determined by analyzing received Mode and Class information.

Figure 7:
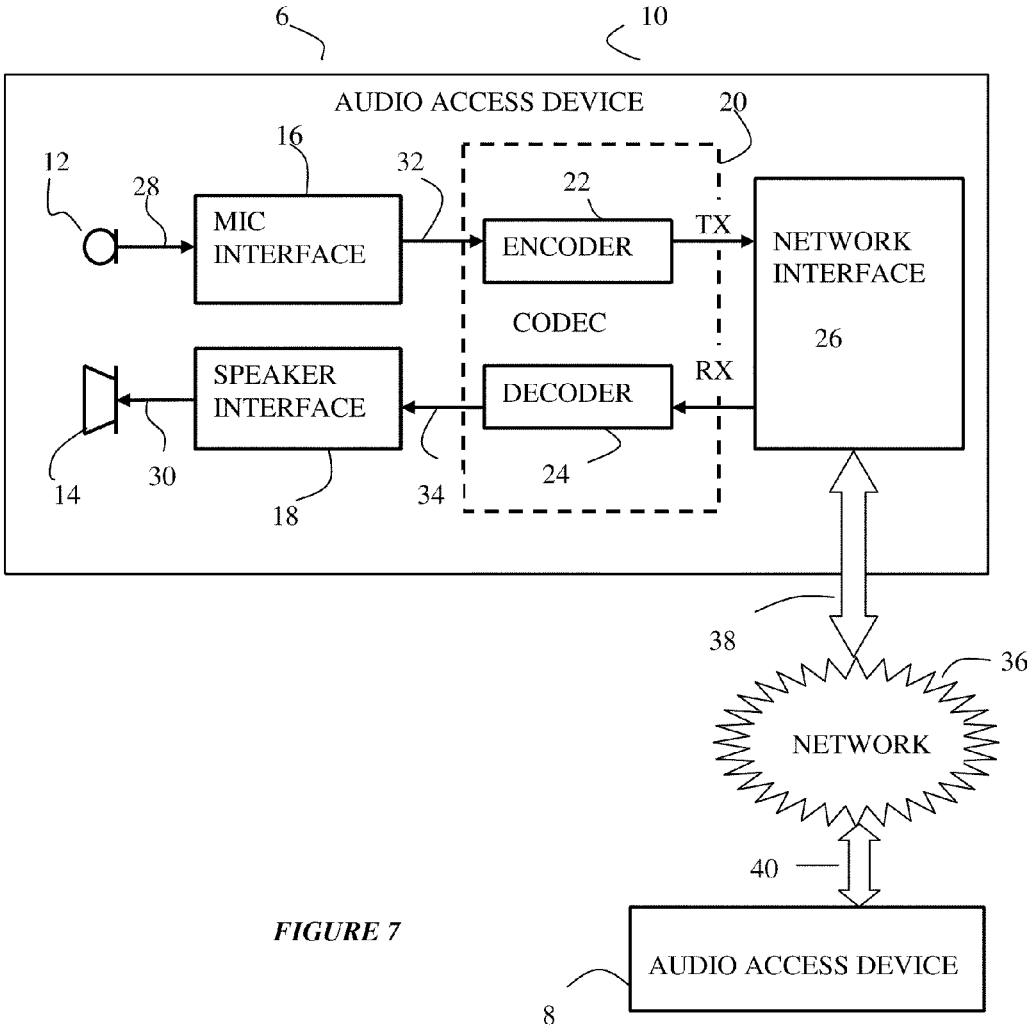
FIG. 7 illustrates a communication system according to an embodiment of the present invention.

FIG. 7 illustrates communication system 10 according to an embodiment of the present invention. Communication system 10 has audio access devices 6 and 8 coupled to network 36 via communication links 38 and 40. In one embodiment, audio access device 6 and 8 are voice over internet protocol (VOIP) devices and network 36 is a wide area network (WAN), public switched telephone network (PSTN) and/or the internet. In another embodiment, audio access device 6 is a receiving audio device and audio access device 8 is a transmitting audio device that transmits broadcast quality, high fidelity audio data, streaming audio data, and/or audio that accompanies video programming. Communication links 38 and 40 are wireline and/or wireless broadband connections. In an alternative embodiment, audio access devices 6 and 8 are cellular or mobile telephones, links 38 and 40 are wireless mobile telephone channels and network 36 represents a mobile telephone network.

Audio access device 6 uses microphone 12 to convert sound, such as music or a person's voice into analog audio input signal 28. Microphone interface 16 converts analog audio input signal 28 into digital audio signal 32 for input into encoder 22 of CODEC 20. Encoder 22 produces encoded audio signal TX for transmission to network 26 via network interface 26 according to embodiments of the present invention. Decoder 24 within CODEC 20 receives encoded audio signal RX from network 36 via network interface 26, and converts encoded audio signal RX into digital audio signal 34. Speaker interface 18 converts digital audio signal 34 into audio signal 30 suitable for driving loudspeaker 14.

In embodiments of the present invention, where audio access device 6 is a VOIP device, some or all of the components within audio access device 6 can be implemented within a handset. In some embodiments, however, Microphone 12 and loudspeaker 14 are separate units, and microphone interface 16, speaker interface 18, CODEC 20 and network interface 26 are implemented within a personal computer. CODEC 20 can be implemented in either software running on a computer or a dedicated processor, or by dedicated hardware, for example, on an application specific integrated circuit (ASIC). Microphone interface 16 is implemented by an analog-to-digital (A/D) converter, as well as other interface circuitry located within the handset and/or within the computer. Likewise, speaker interface 18 is implemented by a digital-to-analog converter and other interface circuitry located within the handset and/or within the computer. In further embodiments, audio access device 6 can be implemented and partitioned in other ways known in the art.

In embodiments of the present invention where audio access device 6 is a cellular or mobile telephone, the elements within audio access device 6 are implemented within a cellular handset. CODEC 20 is implemented by software running on a processor within the handset or by dedicated hardware. In further embodiments of the present invention, audio access device may be implemented in other devices such as peer-to-peer wireline and wireless digital communication systems, such as intercoms, and radio handsets. In applications such as consumer audio devices, audio access device may contain a CODEC with only encoder 22 or decoder 24, for example, in a digital microphone system or music playback device. In other embodiments of the present invention, CODEC 20 can be used without microphone 12 and speaker 14, for example, in cellular base stations that access the PSTN.

Advantages of embodiments include improvement of subjective received sound quality at low bit rates with low cost. Although the embodiments and their advantages have been described in detail, it should be understood that various changes, substitutions and alterations can be made herein without departing from the spirit and scope of the invention as defined by the appended claims. For example, filter bank coefficients can be replaced by FFT coefficients or MDCT coefficients. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method of extending a bandwidth of an audio signal with a time domain approach, the method comprising:

receiving a baseband audio signal having a first frequency content within a first frequency band that extends from zero frequency to a first positive frequency;

up-sampling the baseband audio signal to produce a baseband up-sampled signal;

mirroring the baseband audio signal to produce a baseband mirrored signal, wherein the baseband mirrored signal comprises second frequency content within the first frequency band that is mirrored over frequency with respect to the first frequency content;

up-sampling and low-pass filtering the baseband mirrored signal using non-symmetric low-pass-filtering to produce a high band mirrored signal; and mirroring the high band mirrored signal to produce an extra high band signal; and generating a bandwidth-extended audio signal by summing the extra high band signal and the baseband up-sampled signal, wherein the steps of up-sampling the baseband audio signal, mirroring the baseband audio signal, up-sampling and low-pass filtering the baseband mirrored signal, mirroring the high band mirrored signal, and generating the bandwidth-extended audio signal are performed in a time domain using a hardware-based decoder.

2. The method of claim 1, wherein up-sampling the baseband audio signal comprises performing a combined Windowed Sinc Function and non-symmetric low-pass filtering operation.

3. The method of claim 1, wherein up-sampling and low-pass filtering the baseband mirrored signal comprises performing a combined Windowed Sinc Function and non-symmetric low-pass filtering operation.

4. The method of claim 1, wherein generating the bandwidth-extended audio signal comprises:

scaling and shaping the extra high band signal to produce a scaled extra high band signal; and adding the scaled extra high band signal to the baseband up-sampled signal to produce the bandwidth-extended audio signal.

5. The method of claim 4, wherein scaling and shaping the extra high band signal comprises using limited information transmitted from an encoder to the hardware based decoder.

6. The method of claim 4, wherein scaling and shaping the extra high band signal comprises using information only available at the hardware based decoder without costing an extra bit.

7. The method of claim 1, wherein using the hardware-based decoder comprises using a processor.

8. The method of claim 1, wherein using the hardware-based decoder comprises using a dedicated hardware.

9. The method of claim 1, further comprising combining the baseband up-sampled signal with the extra high band signal to form an output signal.

10. The method of claim 1, wherein:

mirroring the baseband audio signal comprising multiplying −1 with one of two samples of the baseband audio signal; and mirroring the high band mirrored signal comprises multiplying −1 with one of two samples of the high band mirrored signal.

11. A method of extending a bandwidth of an audio signal, the method comprising:

receiving a baseband audio signal having a first frequency content within a first frequency band that extends from zero frequency to a first positive frequency;

up-sampling the baseband audio signal to produce a baseband up-sampled signal;

mirroring the baseband audio signal to produce a baseband mirrored signal, wherein the baseband mirrored signal comprises second frequency content within the first frequency band that is mirrored over frequency with respect to the first frequency content;

up-sampling and low-pass filtering the baseband mirrored signal with non-symmetric low-pass-filtering to produce a high band mirrored signal;

mirroring the high band mirrored signal to produce an extra high band signal;

scaling and shaping the extra high band signal to produce a scaled extra high band signal;

adding a proper noise component to the scaled extra high band signal to produce a final scaled extra high band signal; and adding the final scaled extra high band signal to the baseband up-sampled signal to produce a bandwidth extended audio signal, wherein the steps of up-sampling the baseband audio signal, mirroring the baseband audio signal, up-sampling and low-pass filtering the baseband mirrored signal, mirroring the high band mirrored signal, scaling and shaping the extra high band signal, adding the proper noise component, and adding the final scaled extra high band signal are performed in a time domain using a hardware-based decoder.

12. The method of claim 11, wherein adding the proper noise component comprises using limited information transmitted from encoder to the hardware-based decoder.

13. The method of claim 11, wherein adding the proper noise component comprises using information only available at the hardware-based decoder without costing an extra bit.

14. The method of claim 11, wherein using the hardware-based decoder comprises using a processor.

15. The method of claim 11, wherein using the hardware-based decoder comprises using a dedicated hardware.

16. The method of claim 11, wherein:

mirroring the baseband audio signal comprising multiplying −1 with one of two samples of the baseband audio signal; and mirroring the high band mirrored signal comprises multiplying −1 with one of two samples of the high band mirrored signal.

17. A method of decoding an encoded audio signal comprising:

receiving a baseband audio signal;

producing an extended high band signal from the baseband audio signal;

generating available filter bank coefficients from the encoded audio signal;

estimating a bandwidth extension scaling gain comprising determining time direction energy envelope sharpening gains Gain_t[ ] using energies of at least one of the available filter bank coefficients, determining first gains Gain_1[ ] from nearest available high band filter bank coefficients, determining second gains Gain_2[ ] from an energy ratio between an energy at a lowest frequency area and a lowest energy in all available subbands, and producing the bandwidth extension gain by multiplying the time direction energy envelope sharpening gains Gain_t[ ], the first gains Gain_1[ ] and the second gains Gain_2[ ]; and applying the bandwidth extension scaling gain to extended high band signal; and generating an extended bandwidth audio signal using the extended band signal and the baseband audio signal, wherein the steps of producing the extended high band signal, generating the available filter band coefficients, estimating the bandwidth extension scaling gain, applying the bandwidth extension scaling gain and generating the extended bandwidth audio signal are performed using a hardware-based decoder.

18. The method of claim 17, further comprising initializing the time direction energy envelope sharpening gains Gain_t[ ] as follows:

$$\text{Gain_t}[l] = pow(\text{T_energy_sm}[l], \text{t_control})$$
$$= (\text{T_energy_sm}[l])^{t_control}$$

where T_energy_sm[l] is smoothed time direction energy envelope and t_control is a constant parameter.

19. The method of claim 18, wherein t_control is about 0.125.

20. The method of claim 18, further comprising energy normalizing the initial gains of time direction energy envelope sharpening gains Gain_t[l] at each time index by comparing strongly smoothed original energy T_energy_0_sm[l] to strongly smoothed energy T_energy_1_sm[l] after setting initial gains as follows:

$$\text{Gain_t_norm}[l] = \sqrt{\frac{\text{T_energy_0_sm}[l]}{\text{T_energy_1_sm}[l]}}$$
$$\text{Gain_t}[l] \Longleftarrow \text{Gain_t_norm}[l] \cdot \text{Gain_t}[l],$$

where Gain_t_norm[l] is a normalization gain.

21. The method of claim 17, wherein the first gains Gain_1[l] in each frame is defined as:

$$\text{Gain_1}[l] = pow\left(\frac{MinE1}{MaxE}, C1\right),$$

where C1 is a constant; MinE1 is the local minimum subband energy near the extended high band; and MaxE is the local maximum subband energy near the extended high band.

22. The method of claim 17, wherein the second gains Gain_2[l] are defined as:

$$\text{Gain_2}[l] = pow\left(\frac{MinE2}{LowE}, C2\right),$$

where C2 is a constant; LowE represents a subband energy in the lowest frequency area multiplied by a constant factor that is much smaller than 1; and MinE2 represents a lowest subband energy of all the subbands.

23. The method of claim 17, wherein using the hardware-based decoder comprises using a processor.

24. The method of claim 17, wherein using the hardware-based decoder comprises using a dedicated hardware.

25. A hardware-based audio decoder comprising:

a circuit configured to receive a baseband audio signal having a first frequency content within a first frequency band that extends from zero frequency to a first positive frequency;

up-sample the baseband audio signal to produce a baseband up-sampled signal, mirror the baseband audio signal to produce a baseband mirrored signal, wherein the baseband mirrored signal comprises second frequency content within the first frequency band that is mirrored over frequency with respect to the first frequency content, up-sample and low-pass filter the baseband mirrored signal using non-symmetric low-pass-filtering to produce a high band mirrored signal, mirror the high band mirrored signal to produce an extra high band signal, and generate an extended bandwidth audio signal using the extra high band signal and the baseband up-sampled signal.

26. The hardware-based audio decoder of claim 25, wherein the circuit comprises a processor.

27. The hardware-based audio decoder of claim 25, wherein:

the circuit is configured to mirror the baseband audio signal by multiplying −1 with one of two samples of the baseband audio signal; and the circuit is configured to mirror the high band mirrored signal by multiplying −1 with one of two samples of the high band mirrored signal.

28. A method of post-processing a decoded audio signal comprising:

receiving a baseband audio signal;

producing an extended high band signal from the baseband audio signal;

generating available filter bank coefficients from the baseband audio signal;

estimating a time direction energy envelope shaping gains Gain_t[ ] comprising:

determining a time direction energy envelope of the available filter bank coefficients from the baseband audio signal, smoothing the time direction energy envelope to get a smoothed time direction energy envelope of the available filter bank coefficients from the baseband audio signal, normalizing the smoothed time direction energy envelope to get a normalized and smoothed time direction energy envelope so that the normalized and smoothed time direction energy envelope is not related to over-all energy of the baseband audio signal but still reflects the time direction energy envelope shape of the baseband audio signal, producing the time direction energy envelope shaping gains Gain_t[ ] by using the normalized and smoothed time direction energy envelope of the available filter bank coefficients from the baseband audio signal;

multiplying the time direction energy envelope shaping gains Gain_t[ ] with the extended high band signal to form a multiplied extended high band signal; and generating a bandwidth-extended audio signal using the multiplied extended high band signal and the baseband audio signal, wherein the steps of determining the time direction energy envelope, smoothing the time direction energy envelope, normalizing the smoothed time direction energy envelope, producing the time direction energy envelope shaping gains Gain_t[ ], multiplying the time direction energy envelope shaping gains Gain_t[ ], and generating the extended bandwidth audio signal are performed using a hardware-based decoder.

* * * * *